US007491141B1

(12) United States Patent
Tucker, Sr. et al.

(10) Patent No.: US 7,491,141 B1
(45) Date of Patent: Feb. 17, 2009

(54) LACROSSE HEAD HAVING A SKELETAL MEMBER

(75) Inventors: Richard B. C. Tucker, Sr., Ruxton, MD (US); Richard B. C. Tucker, Jr., Baltimore, MD (US)

(73) Assignee: STX, LLC, Baltimore, MD (US)

( * ) Notice: Subject to any disclaimer, the term of this patent is extended or adjusted under 35 U.S.C. 154(b) by 199 days.

(21) Appl. No.: 11/030,947

(22) Filed: Jan. 10, 2005

Related U.S. Application Data

(60) Provisional application No. 60/534,969, filed on Jan. 9, 2004.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

| | | | | | |
|---|---|---|---|---|---|
| 491,558 | A * | 2/1893 | Hill | 124/5 |
| 1,555,164 | A * | 9/1925 | Schwartz | 473/544 |
| 2,596,894 | A | 5/1952 | Frisch | |
| 3,507,495 | A * | 4/1970 | Fracalossi et al. | 473/513 |
| 3,910,578 | A | 10/1975 | Brine, Jr. | |
| 4,034,984 | A | 7/1977 | Crawford | |
| 4,097,046 | A | 6/1978 | Friant | |
| 4,138,111 | A * | 2/1979 | Rule | 473/513 |
| 4,358,117 | A | 11/1982 | Deutsch | |
| 4,643,857 | A * | 2/1987 | Cousin et al. | 264/46.6 |
| 5,007,652 | A * | 4/1991 | Tucker et al. | 473/513 |
| 5,566,947 | A | 10/1996 | Tucker | |
| 5,685,791 | A | 11/1997 | Feeney | |
| 5,935,026 | A * | 8/1999 | Dill et al. | 473/513 |
| 6,723,134 | B2 | 4/2004 | Tucker | |
| 7,226,374 | B2 * | 6/2007 | Morrow et al. | 473/513 |
| 2004/0002398 | A1 * | 1/2004 | Morrow et al. | 473/513 |
| 2004/0072637 | A1 * | 4/2004 | Morrow et al. | 473/513 |
| 2004/0116217 | A1 | 6/2004 | Morrow et al. | |
| 2005/0064963 | A1 | 3/2005 | Filice et al. | |
| 2005/0215359 | A1 | 9/2005 | Gait | |

FOREIGN PATENT DOCUMENTS

| | | |
|---|---|---|
| GB | 424 742 | 2/1935 |

* cited by examiner

*Primary Examiner*—Gene Kim
*Assistant Examiner*—M Chambers
(74) *Attorney, Agent, or Firm*—Paul, Hastings, Janofsky & Walker LLP

(57) ABSTRACT

A lacrosse head having a skeletal member and an outer skin that encapsulates the skeletal member. In an embodiment of the invention, the outer skin is made of a material that is more energy absorbing than the material of the skeletal member. Corresponding methods for making the lacrosse head are also disclosed.

24 Claims, 16 Drawing Sheets

LACROSSE HEAD HAVING A SKELETAL MEMBER

This application claims the benefit of U.S. Provisional Application No. 60/534,969, filed Jan. 9, 2004, which is herein incorporated by reference in its entirety.

BACKGROUND

1. Field of the Invention

The present invention relates generally to lacrosse sticks, and more particularly, to lacrosse stick heads having a skeletal member made of a first material, over which an outer skin made of a second material is applied.

2. Background of the Invention

In 1970, the introduction of double-wall, synthetic lacrosse heads revolutionized the game of lacrosse. In comparison to the traditional wooden single-wall heads, the synthetic heads imparted a balance, lightness, maneuverability, and flexibility never-before experienced by lacrosse players. These performance advantages greatly enhanced players' skills such as throwing, catching, cradling, and scooping, and brought the sport of lacrosse to new levels of speed and excitement.

FIG. 1 illustrates a conventional lacrosse stick 100 having a handle 102 shown in dotted lines and a double-wall synthetic head 104. Head 104 includes a generally V-shaped frame having a juncture 106, sidewalls 108 and 110, a transverse wall (or "scoop") 112 joining the sidewalls at their ends opposite juncture 106, and a stop member 114 joining sidewalls 108 and 110 at their ends nearest juncture 106. As shown, handle 102 fits into and through juncture 106, and abuts stop member 114. A screw or other fastener placed through opening 107 secures handle 102 to head 104.

For traditionally-strung pockets (which have thongs and string instead of mesh), thongs (not shown) made of leather or synthetic material extend from upper thong holes 116 in scoop 112 to lower thong holes 118 in stop member 114. In some designs, such as the design shown in FIG. 1, upper thong holes 116 are located on tabs 117 of the scoop 112. On other designs, upper thong holes 116 are located directly on the scoop 112. FIG. 1 shows four pairs (116, 118) of thong holes that accept four thongs. To complete the pocket web, the thongs have nylon strings threaded around the thongs and string laced through string holes 120 in sidewalls 108 and 110, forming any number of diamonds (crosslacing). Finally, one or more throwing or shooting strings extend transversely between the upper portions of sidewalls 108 and 110, attaching to throwing string hole 124 and a string laced through string hole 122. The typical features of a lacrosse stick are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

In addition to traditionally-strung heads, some heads use mesh pockets or a combination of traditional and mesh stringing. In any case, the mesh or stringing is conventionally attached to the head through holes in the scoop, sidewalls, and stop members, or by tabs attached to the scoop, sidewalls, and stop members. These tabs can have openings through which mesh or stringing is threaded, or can be shaped (e.g., like a hook) to retain loops of the mesh or stringing.

As used herein, thread holes or thread openings refer to the openings that receive the various forms of pocket stringing, such as the holes in the scoop, sidewalls, and stop members, or the openings in tabs attached to the scoop, sidewalls, and stop members. The term "openings" should be construed broadly so as to encompass any hole or structure that retains the pocket stringing, including structures such as hooks. Also, as used herein, a pocket thread refers to any member, such as a thong, string, or mesh, that forms the pocket and/or attaches the pocket to the lacrosse head.

The traditional double-wall synthetic head is an injection-molded, monolithic structure. Examples of suitable synthetic materials well known in the art include nylon, urethane, and polycarbonate. When first introduced, these materials were clearly superior to wood, offering players improved handling and durability. For example, a lacrosse head constructed of DuPont™ ZYTEL ST 801 nylon resin is able to withstand the bending and harsh impacts inherent to competition far better than a traditional wooden stick. As another example, polycarbonate, though having a flexibility similar to wood, is more structurally durable than wood and much lighter and, therefore, easier to handle.

Although the synthetic materials can afford significant performance advantages, the use of a single material in a monolithic head limits a manufacturer's ability to satisfy divergent performance characteristics. For example, to provide better ball control during face-offs or when scooping ground balls, a player may prefer a strong but deformable lacrosse head that returns to its original shape once the deforming force is removed. At the same time, a player may desire a less rigid, compressible, vibration-dampening lacrosse head that absorbs impacts to the lacrosse head by other sticks to help prevent a ball from being jarred from the head. With a monolithic head, the manufacturer must choose a material that serves both of these disparate purposes. Although the manufacturer can compensate somewhat for this performance tradeoff by using structural elements (e.g., increasing the thickness of the sidewalls), the practical result of the tradeoff is a lacrosse head that satisfies neither purpose optimally.

There are many other examples of these types of tradeoffs in choosing a material for a monolithic lacrosse head. For example, providing the necessary rigidity in a monolithic lacrosse head can compromise the ability to provide a dampening pocket. In an effort to deepen a pocket as much as possible, some conventional men's lacrosse heads maximize the height of the sidewalls to the upper limit of 2 inches that is mandated by applicable rules. Coupled with the maximum allowed 2½-inch pocket (the diameter of a lacrosse ball), this sidewall height provides the lacrosse head with the maximum allowed total depth of 4½ inches. Unfortunately, maximizing the height of the traditional monolithic rigid sidewall does not enhance the flexibility of the pocket in any way. The rigid frame of the traditional lacrosse head can make the overall catching area stiff and unforgiving. Indeed, the only non-rigid component of the conventional men's lacrosse head is the 2½ inches of pocket. A sharp jolt to the stick, as often happens when a player is checked, can cause the stiff frame to jerk the pocket and propel the ball out of the lacrosse head. Players would therefore prefer a less rigid lacrosse head that better dampens the pocket to keep a ball in the lacrosse head.

Another significant tradeoff pertains to the hardness of the lacrosse head. To provide the rigidity necessary to handle and protect the heavy, hard rubber ball, and to provide the durability necessary to endure the severe impacts of the game, synthetic materials must possess a substantial degree of stiffness, strength, and abrasion resistance. A drawback to these characteristics is the frequent injuries inflicted upon other lacrosse players by impact with the hard lacrosse head. Often, players have their fingers crushed between the lacrosse head of an opponent and the lacrosse stick handle that they are holding. In addition, throwing and checking with the lacrosse sticks regularly result in inadvertent or deliberate contact with players' faces, arms, and other body parts. This injury problem is a particular concern for the women's game, in which the players wear virtually no personal protective equipment (e.g., no helmets or padding), yet the lacrosse heads are made of the same materials used in the men's heads. Further, in the women's game, despite game rules designed to avoid stick contact with the body, inadvertent contact with body parts regularly occurs.

On a larger scale, this injury problem is detrimental to the sport's popularity, as many young players are discouraged by the pain of routine contact. To reduce injuries, manufacturers could choose a softer lacrosse head material. However, a lacrosse head with a significantly lower flex modulus leads to excessive flexing, poor recovery from flexing, and inadequate rigidity for ball handling and legal checking purposes.

In an effort to soften the hard monolithic heads, some designs, such as that disclosed in British Patent No. 424,742 to Muir, attach soft materials using adhesives to a hard lacrosse head frame. Muir attaches a rubber sheath to a traditional wood frame. As observed in a cross-sectional view, the sheath represents only a very small portion of the cross-sectional area of the Muir head, with the overwhelming area attributable to the wood frame.

Another example of a performance tradeoff concerns the rigidity of the lacrosse head frame in relation to the tightness of the pocket strings. With conventional monolithic lacrosse heads, the stiffer the material of the head, the less the head flexes or "gives" in response to tension on the pocket. As a result, the pocket in a women's lacrosse head can become excessively tight, such that impact with the ball causes a trampoline effect that makes the ball hard to catch and control. In essence, the pocket, strung on a rigid unforgiving frame, acts like the strings of a tennis racquet and rebounds the ball out of the pocket. This trampoline effect is especially troublesome for women's lacrosse sticks, which have shallower and more tightly strung pockets than men's lacrosse sticks. (According to United States lacrosse rules, the combined height of the sidewall and pocket of women's lacrosse stick cannot exceed 2½ inches, while the men's can be up to 4½ inches, in effect allowing a standard 2½ inch ball to sag 2 inches below the men's sidewall.) Again, restricted to a monolithic head, a manufacturer could use a more energy absorbing material to reduce the trampoline effect. However, using a more energy absorbing material can make the head less rigid and less suitable for accurate passing and shooting, and for protecting against ball-jarring hits.

Another example of a tradeoff in performance characteristics relates to areas of a lacrosse head that must satisfy needs significantly different from the principal concerns of rigidity and flexibility. For example, manufacturers typically add a separate ball stop to the stop area of a lacrosse head to help deaden incoming balls. Conventionally, this piece is made of highly compressible, energy-absorbing material, e.g., foam. This foam ball stop is typically applied to the lacrosse head with adhesive and serves to absorb the ball's impact with the hard lacrosse head and thereby improve ball control. With monolithic lacrosse heads, constructing the entire head of this foam is completely impractical because of its lack of strength and rigidity. Thus, due to the playing characteristics expected of a modern lacrosse head, manufacturers have been unable to produce a lacrosse head with a shock absorbing stop area without adding a separate ball stop.

In addition to injection-molded synthetic lacrosse heads, some lacrosse stick designers have experimented with composite materials to form a lacrosse head, an example of which is described in U.S. Pat. No. 5,685,791 to Feeney. The composite lacrosse stick head of Feeney comprises a tube with a generally oval-shaped cross section with a length shaped into a closed loop head. The tube is fabricated of elongated fibers in a parallel configuration. The fibers are applied in layers and are set in an elastomeric binder material. Notably, the composite lacrosse stick head of Feeney is hollow and includes the composite tube as its only structure. The pocket is strung to holes or apertures in the composite tube, which are preferably drilled in the head during a secondary operation.

In shaping the tube, a thin air bladder is placed inside the wound strips of composite material. After the windings are bent to the intended configuration corresponding to the lacrosse stick head, the windings are placed in a mold. The bladder is then inflated to keep the windings in contact with the mold for shaping during curing. Alternatively, instead of air, the bladder can be filled with a foam material that expands when heated and provides the necessary forming pressure during the cure cycle. Importantly, however, because this foam is inside of the tube, it cannot provide any flexibility to the lacrosse head and does not structurally support the head. Instead, only the composite tube provides structural support and any inherent flexibility it may have.

Thus, in view of the drawbacks of conventional injection-molded monolithic heads and composite heads, there remains a need for a lacrosse head that better satisfies the divergent performance requirements discussed above. In particular, there remains a need for a lacrosse head that possesses the necessary structural support while also satisfying preferences for pocket dampening, ball control, protective cushioning, and light weight.

SUMMARY OF THE INVENTION

The present invention provides a lacrosse head having a skeletal member encapsulated in an outer skin. The skeletal member is made of a first material and the outer skin is made of a second, different material.

The skeletal member provides the lacrosse head with both structural support and springiness (which is defined herein as both elasticity and resiliency). In other words, the skeletal member provides the lacrosse head with enough stiffness to withstand the typical forces applied to a lacrosse head, such as the pull of the pocket (from both pocket tension and ball impacts) and impacts with the ground, other sticks, and players. At the same time, the skeletal member is springy to provide both elasticity and resiliency. In this respect, the skeletal member can stretch or compress, and then recover quickly to its original shape, form, or position. Examples of materials that can meet these performance requirements include metals, plastics, and composites. As used herein, composites refer to materials having fibers in a thermoset or thermoplastic resin matrix. Typically, these composites are made by wrapping sheets of uncured fiber-reinforced resin (e.g., fiberglass, carbon, or aramid) around a mandrel, which is then withdrawn to form a hollow tubular layup.

The outer skin provides the lacrosse head with springiness, and is made of a material that is more energy or shock absorbing than the material of the skeletal member. In one embodiment, this relationship between the outer skin and the skeletal member is measured by durometer hardness, with the material of the outer skin having a lower durometer hardness than the material of the skeletal member. In this manner, the outer skin provides a more forgiving material, which can be used to, for example, dampen the lacrosse head pocket and cushion impacts with players' bodies. Examples of materials that can meet these performance requirements include plastics such as nylon, urethane, sanoprene, polycarbonate, polyethylene, polypropylene, polyvinyl chloride (PVC), and ABS.

With this structure, the present invention provides a lacrosse head that derives the necessary inner structural support and inner springiness from the skeletal member and the necessary outer springiness and "give" from the outer skin. In one embodiment, the skeletal member is less than a completely functional lacrosse head, lacking necessary features such as pocketing threading holes. The outer skin encapsulating the skeletal member provides the "give" in desirable areas such as along the upper and lower surfaces of the sidewalls.

Acting in conjunction, the skeletal member and the outer skin can provide benefits to the lacrosse head, including at least one of: 1) multi-directional pocket dampening that enhances ball control; 2) flexible sidewalls that increase a pocket's range of motion during cradling; 3) cushioning provided by the compressible outer skin that helps prevent injury to players and absorbs impacts by other sticks; and 4) improved performance characteristics relating to lightness, aerodynamics, maneuverability, and/or throwing accuracy.

DETAILED DESCRIPTION OF THE INVENTION

Figure 1:
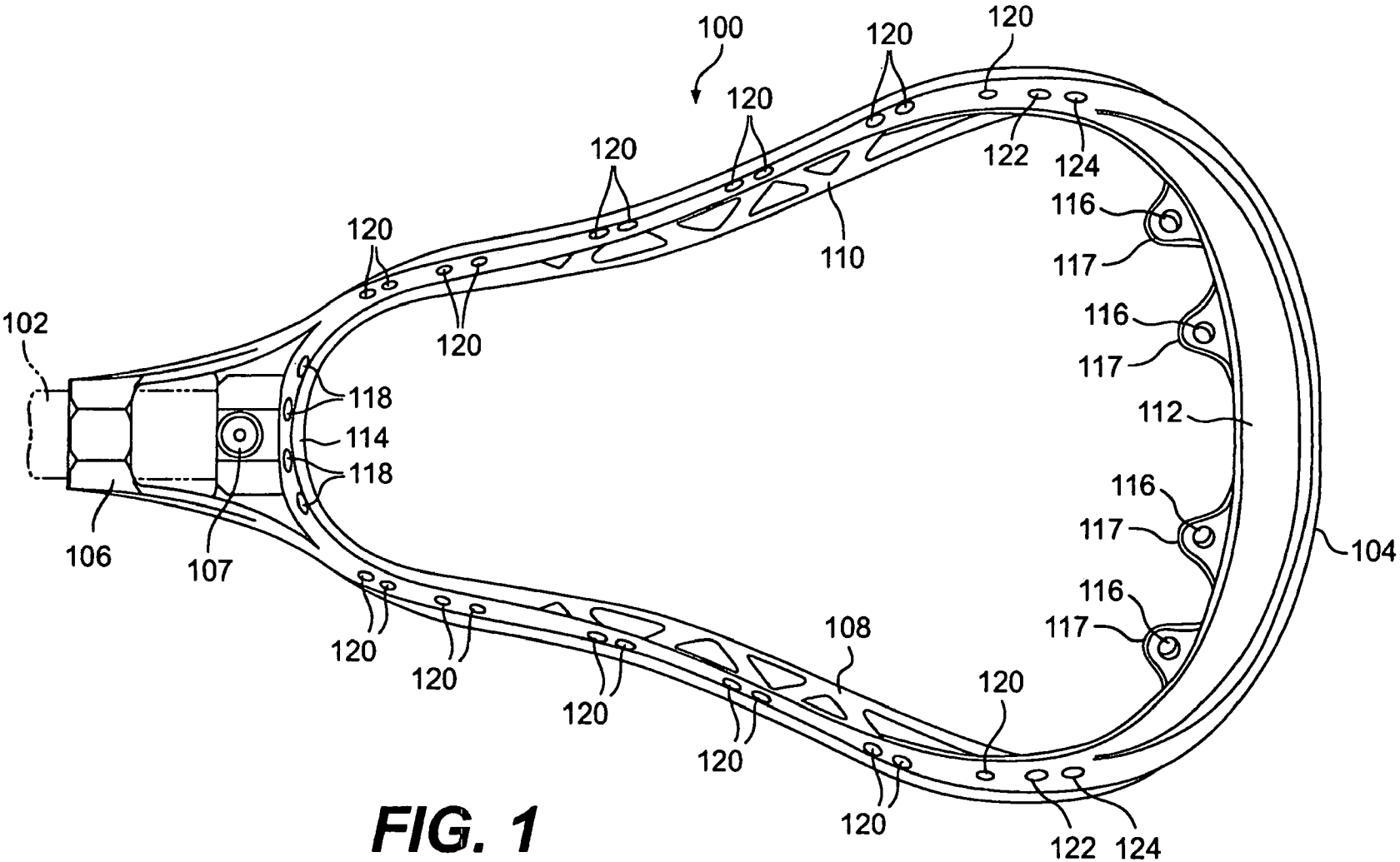
FIG. 1 PRIOR ART
FIG. 1 is a schematic diagram of a lacrosse stick.
Figure 2A:
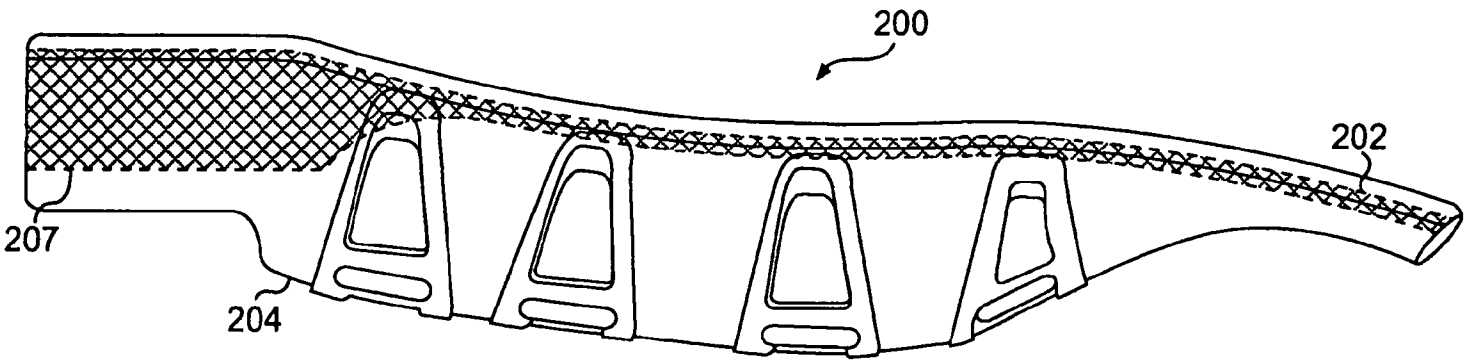
FIG. 2A is a schematic diagram of an exemplary lacrosse stick head, according to an embodiment of the present invention.

FIG. 2A illustrates an embodiment of the present invention in which a lacrosse head 200 includes a skeletal member 202 encapsulated by an outer skin 204. As used herein, the term "encapsulated" refers to the complete covering of a skeletal member in a radial direction around the skeletal member. For example, a skeletal member is encapsulated if, in a cross section of that member taken perpendicularly to the axis of that member, the section of the member is completely enclosed within the cross-section of the outer skin. FIG. 2F illustrates an exemplary cross-section defining this feature. As shown, a skeletal member 297 is radially enclosed within an outer skin 299.

Referring again to FIG. 2A, skeletal member 202 provides lacrosse head 200 with inner structural support and inner springiness. The structural support enables the lacrosse head to resist the tension of the pocket threading as well as pressures and impacts applied to all sides of the head, which are commonly encountered during normal play. The springiness enables lacrosse head 200 to deform and then recover to its original size and shape. Skeletal member 202 is, for example, made of spring steel or a carbon fiber composite. The dimensions of skeletal member 202 are as small as possible, limited only by the structural properties of the material from which it is made. In one embodiment, the cross-sectional area of skeletal member 202 (e.g., at a point on a sidewall) is less than half of the cross-sectional area of outer skin 204 (see, for example, FIG. 2F). (In calculating the cross-sectional area of the outer skin, the cross-sectional area of the skeletal member would not be included.) Limiting the dimension of skeletal member 202 in this manner enables a larger outer skin 204, which, by its springiness and yield strength, provides favorable pocket dynamics (e.g., swing and damping), as discussed in more detail below in reference to FIGS. 3-4D. In a specific implementation, skeletal member 202 is a thin rod, e.g., a carbon fiber composite rod of 0.5-1.5 centimeters in diameter formed in the shape of a lacrosse head (e.g., generally V-shaped). Skeletal member 202 could be hollow or solid.

Figure 2B:
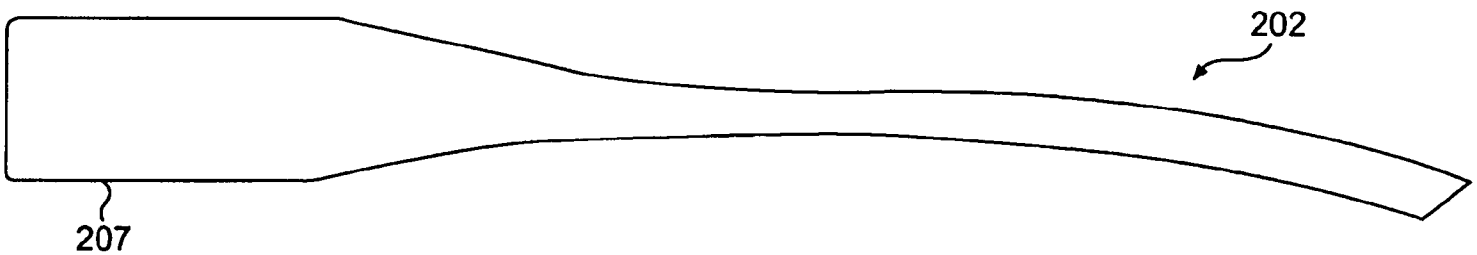
FIG. 2B is a schematic diagram of an exemplary skeletal member, according to an embodiment of the present invention.

In one embodiment, skeletal member 202 forms the juncture 207 of head 200, as shown in FIGS. 2A and 2B. This juncture 207 receives a shaft (not shown) connected to head 200. In this manner, skeletal member 202 can provide a desired structural strength and rigidity in connecting head 200 to a shaft. At the same time, outer skin 204 can provide pocket dampening, ball control, and protective cushioning, as described in more detail below.

As an example, lacrosse head 200 can include a skeletal member 202 formed in a closed loop, with skeletal member 202 forming a juncture 207 of head 200 adapted to receive a shaft (not shown). Outer skin 204 can be applied over skeletal member 202. Skeletal member 202 and outer skin 204 can together form a stop member adjacent to juncture 207, two sidewalls connected to the stop member, and a scoop connected to the two sidewalls opposite the stop member. Outer skin 204 can encapsulate at least a portion of skeletal member 202 along the two sidewalls. In addition, skeletal member 202 can have a cross-sectional area less than approximately half of a cross-sectional area of the outer skin 204 at a cross-section taken along a sidewall of the lacrosse head. Thus, juncture 207 of skeletal member 202 can provide the necessary structural support to attach head 200 to a handle (not shown) disposed in juncture 207.

As another example, lacrosse head 200 can include a stop member, a first sidewall and a second sidewall connected to the stop member, a scoop opposite the stop member that connects the first sidewall to the second sidewall, and a juncture connected to the stop member. Skeletal member 207 of head 200 can include a juncture portion, a ball stop portion, a first sidewall member, and a second sidewall member. The juncture portion can be disposed in the juncture, with the juncture portion defining a socket for receiving a handle. The ball stop portion can be connected to the juncture portion and disposed in the stop member. The first sidewall member can be connected to the ball stop portion and disposed in the first sidewall. The second sidewall member can be connected to the ball stop portion and disposed in the second sidewall. Outer skin 204 can be applied over skeletal member 202, with skeletal member 202 and outer skin 204 together forming the stop member, the first sidewall, and the second sidewall. Outer skin 204 can encapsulate at least a portion of skeletal member 202 along the first sidewall and the second sidewall. Thus, juncture 207 of skeletal member 202, and the socket that it defines, can provide the necessary structural support to attach head 200 to a handle (not shown) disposed in juncture 207.

Although skeletal member 202 provides structural support and springiness, it is important to note that skeletal member 202, by itself, may not provide a complete, functioning lacrosse head. The outer skin 204 may be necessary to provide the complete frame of lacrosse head 200. For example, in the embodiment of FIG. 2A, skeletal member 202 is simply a rod that does not accept pocket threads—rather, outer skin 204 provides the structure to which the pocket threads are attached.

Applied over skeletal member 202, outer skin 204 completes lacrosse head 200. Outer skin 204 provides lacrosse head 200 with springiness and yield strength, and is made of a material that is more energy absorbing than the material of the skeletal member. In one embodiment, this relationship between outer skin 204 and skeletal member 202 is measured by durometer hardness, with the material of outer skin 204 having a lower durometer hardness than the material of skeletal member 202. As an example, outer skin 204 could be made of a clear elastomer or a polycarbonate such as Lexan™.

Outer skin 204 can provide thread openings to which a pocket can be strung. In this manner, outer skin 204 can dampen the pocket in multiple directions. In other words, the material of outer skin 204 deflects in response to a pull by the pocket in any direction and then returns to its original size, shape, and position.

The springiness of outer skin 204 also allows the sidewalls of the lacrosse head to bend (by stretching and compressing) in a side-to-side plane. This movement promotes a wider range of pocket swing, to help keep the ball within the pocket while running, dodging, and withstanding checks. The compressible characteristics provided by outer skin 204's springiness also provide players with protection against impacts with the lacrosse head, which have become more frequent and intense in the modern game due to lighter handles and heads and stronger players.

Figure 2D:
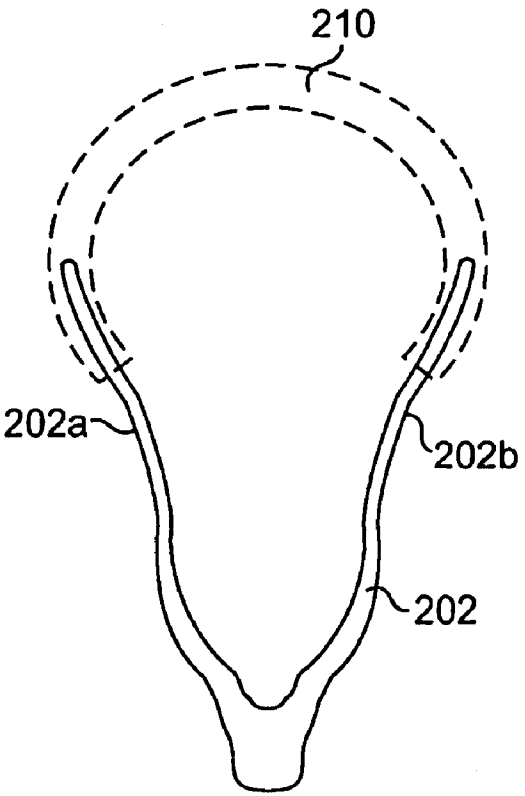
FIG. 2D is a schematic diagram of an exemplary skeletal member interrupted along the length of the scoop, according to an embodiment of the present invention.
Figure 2C:
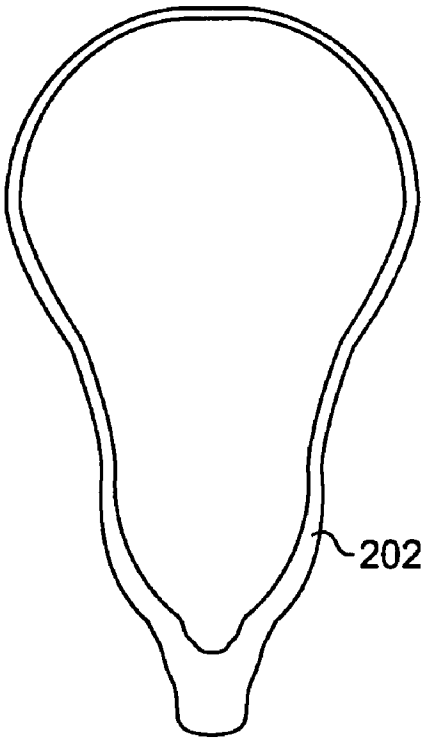
FIG. 2C is a schematic diagram of an exemplary skeletal member formed in a closed loop, according to an embodiment of the present invention.
Figure 2F:
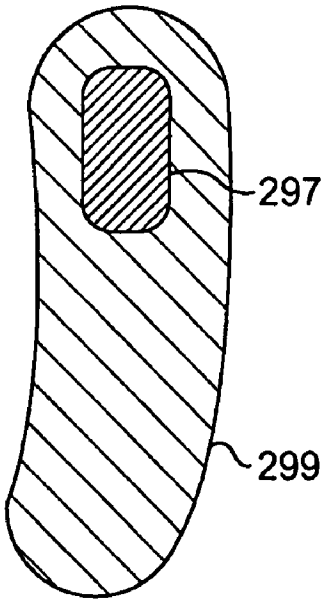
FIG. 2F is a schematic diagram of a cross-section an exemplary skeletal member radially enclosed within an outer skin, according to an embodiment of the present invention.

FIGS. 2B-2E illustrate skeletal member 202 alone, before outer skin 204 is applied. As shown, in this embodiment, skeletal member 202 is a simple shape that approximates the overall shape of lacrosse head 200 and provides a juncture adapted to receive a handle. As shown in FIG. 2C, skeletal member 202 can form a generally V-shaped closed loop that approximates the traditional shape and dimension of a conventional lacrosse head.

In an alternative embodiment, skeletal member 202 is interrupted around the generally V-shaped lacrosse head. In one example, as shown in FIG. 2D, the skeletal member 202 is interrupted along the length of the scoop 210, effectively creating two skeletal member portions 202*a* and 202*b*, each extending from the ball stop area of the lacrosse head to the a point on the sidewalls approaching the scoop. In this example, scoop 210 is formed entirely of the material of the outer skin.

Figure 2E:
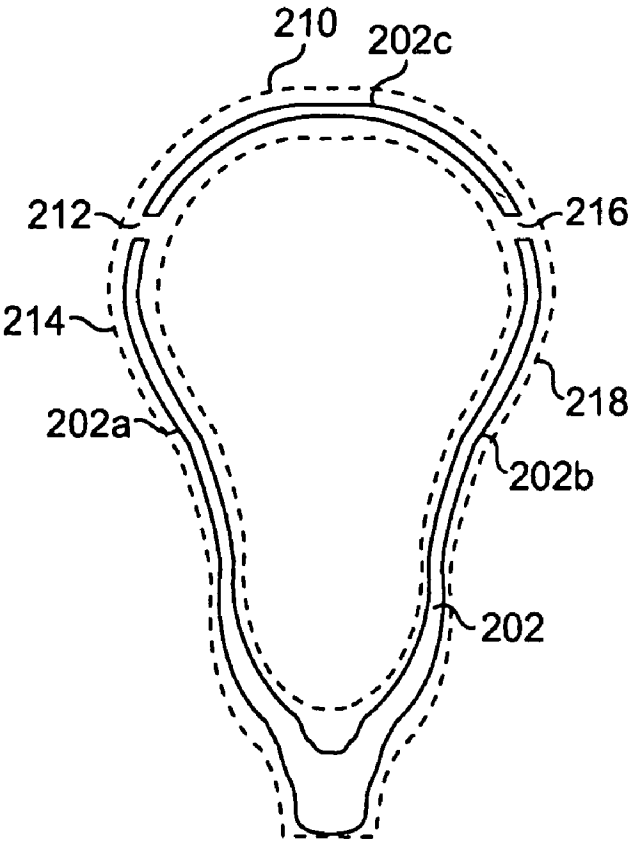
FIG. 2E is a schematic diagram of an exemplary skeletal member interrupted in two locations, according to an embodiment of the present invention.

In another example, as shown in FIG. 2E, skeletal member 202 is interrupted in two places, one at a location 212 approximately where the first sidewall 214 meets the scoop 210 and another at a location 216 approximately where the second sidewall 218 meets the scoop 210. These interruptions 212 and 216 in skeletal member 202 effectively create three skeletal member sections 202*a*, 202*b*, and 202*c* that are spaced apart from each other. Of course, skeletal member 202 could be configured with any number of interruptions, as necessary to provide an appropriate degree of structural support and springiness to a particular lacrosse head.

In addition to the shape and number of sections of the skeletal member, the position of the skeletal member within the outer skin can vary. For example, in one embodiment, the skeletal member is disposed near the lacrosse head face (i.e., the side of the head through which the ball enters), running along the top of the sidewalls. In this manner, the skeletal member can provide the face of the lacrosse head with strong structural support, in the places most likely to be impacted during play. With the skeletal member near the face, the outer skin can then be essentially "draped" over the skeletal member such that more of the outer skin is disposed on the back side (i.e., the side opposite the face) of the skeletal member than on the front side (i.e., the face side) of the skeletal member. Positioning the skeletal member this way enhances the outer skin's ability to provide flex, give, and swing to the sidewalls.

In an alternative embodiment, the skeletal member is disposed toward the back side of the lacrosse head, thereby providing a wider portion of the outer skin on the front side of the skeletal member. This configuration would be suitable, for example, when cushioning the front side of the lacrosse head is a primary concern (e.g., to protect players from injury).

In another alternative embodiment, the skeletal member includes an upper and lower member, for example, with the upper member disposed toward the front side of the lacrosse head and the lower member disposed toward the back side of the head. As an example, within a sidewall, a skeletal member could diverge into two members and then converge back to one member.

Figure 3:
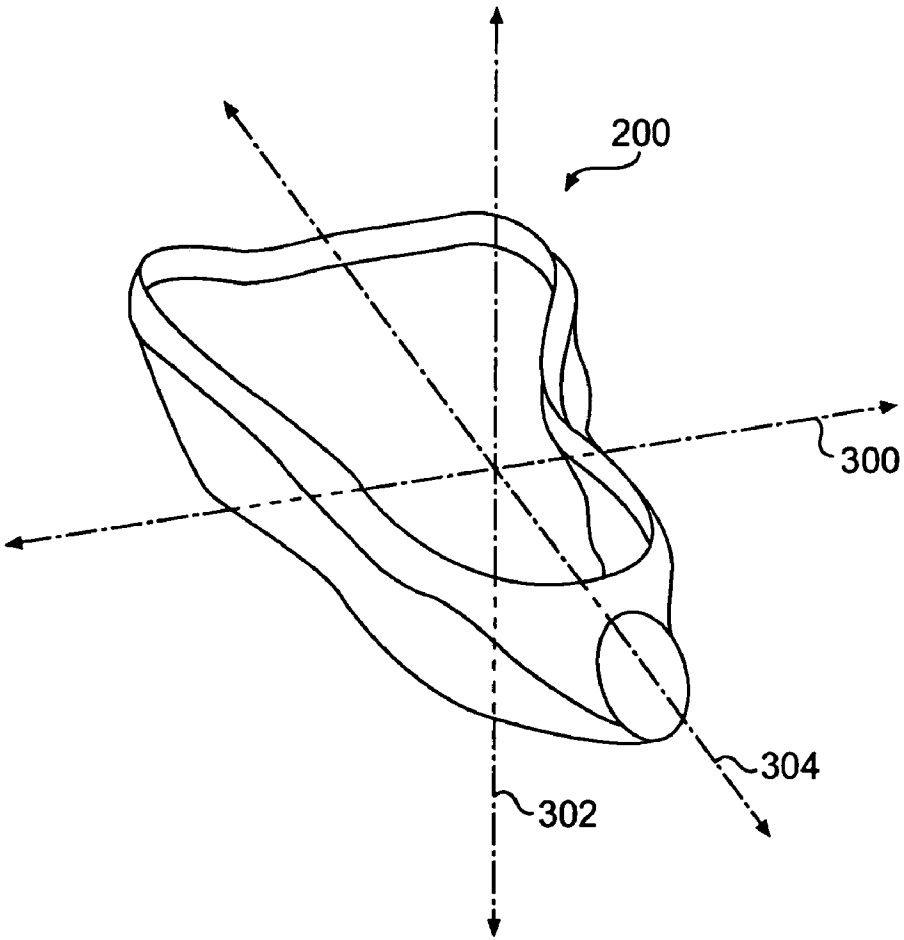
FIG. 3 is a schematic diagram illustrating the multi-directional dampening provided by an exemplary lacrosse stick head, according to an embodiment of the present invention.

In operation, outer skin 204 of the present invention provides lacrosse head 200 with beneficial multi-directional pocket dampening, as shown in FIG. 3. As mentioned above, outer skin 204 can be made of a springy material, which enables the outer skin to stretch and compress in response to a pull of the pocket threads, and then recover to its original shape, size, and position. The outer skin provides this springiness in many directions. Thus, with the pocket attached to the outer skin around the generally V-shaped lacrosse head, the outer skin can spring in any direction in which it is pulled by the pocket and provide the desired pocket dampening.

For example, as shown in FIG. 3, the most common directions would include a side-to-side direction 300 (e.g., during cradling when the pocket swings side-to-side), a front-to-back direction 302 (e.g., when catching a ball in the pocket), and a top-to-bottom direction 304 (e.g., after a ball initially impacts the pocket and rolls down the pocket to the ball stop). As one of ordinary skill in the art would appreciate, in actual use, the outer skin would move in various components of these vector directions. Indeed, outer skin 204 can provide omni-directional pocket dampening.

According to an embodiment of the present invention, pocket webbing attaches to thread holes disposed in various locations of outer skin 204, including the traditional thong and string holes or tabs in the scoop, sidewalls, and ball stop. Outer skin 204 therefore provides an anchor that deflects in response to the pull of a pocket thread, dampens the pull, and then recovers to its original position to limit pocket rebound. The potential movement of the outer skin 204, especially with respect to the sidewalls, also increases the range of pocket swing during cradling and allows a ball within the pocket to swing farther under the lacrosse head (e.g., in the direction of arrow 300), thereby enhancing a player's ability to keep the ball under control within pocket while running or withstanding checks.

Figure 4A:
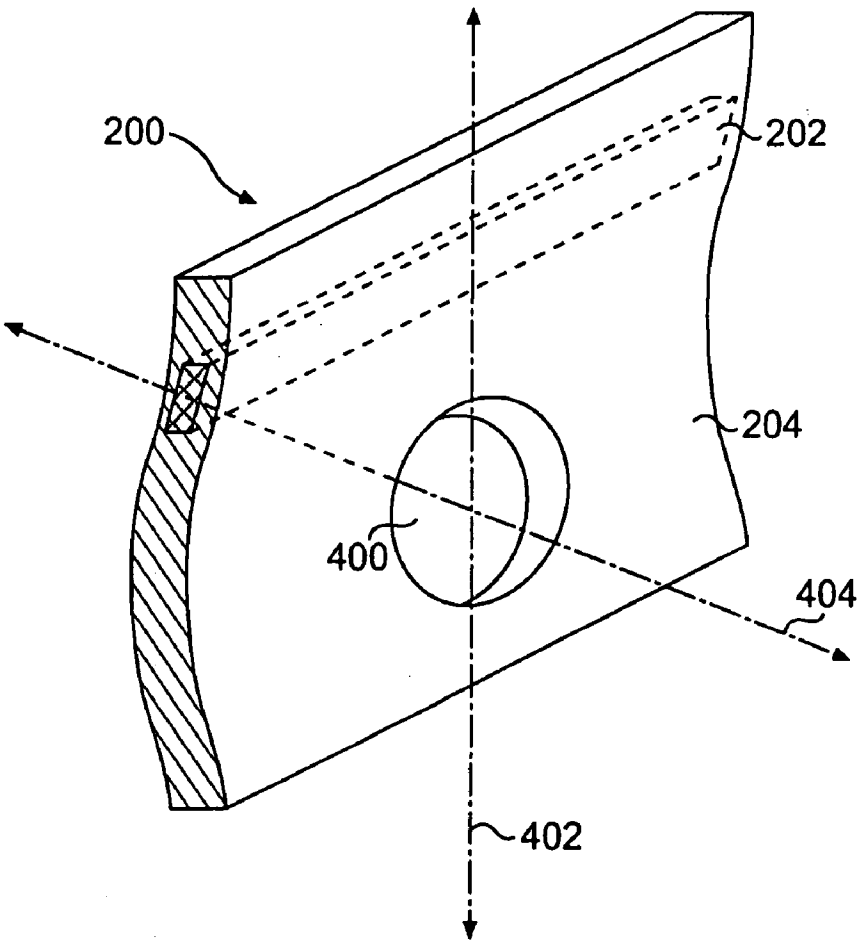
FIG. 4A is a schematic diagram of a section of an exemplary lacrosse stick head showing a thread hole through the outer skin, according to an embodiment of the present invention.
Figure 4B:
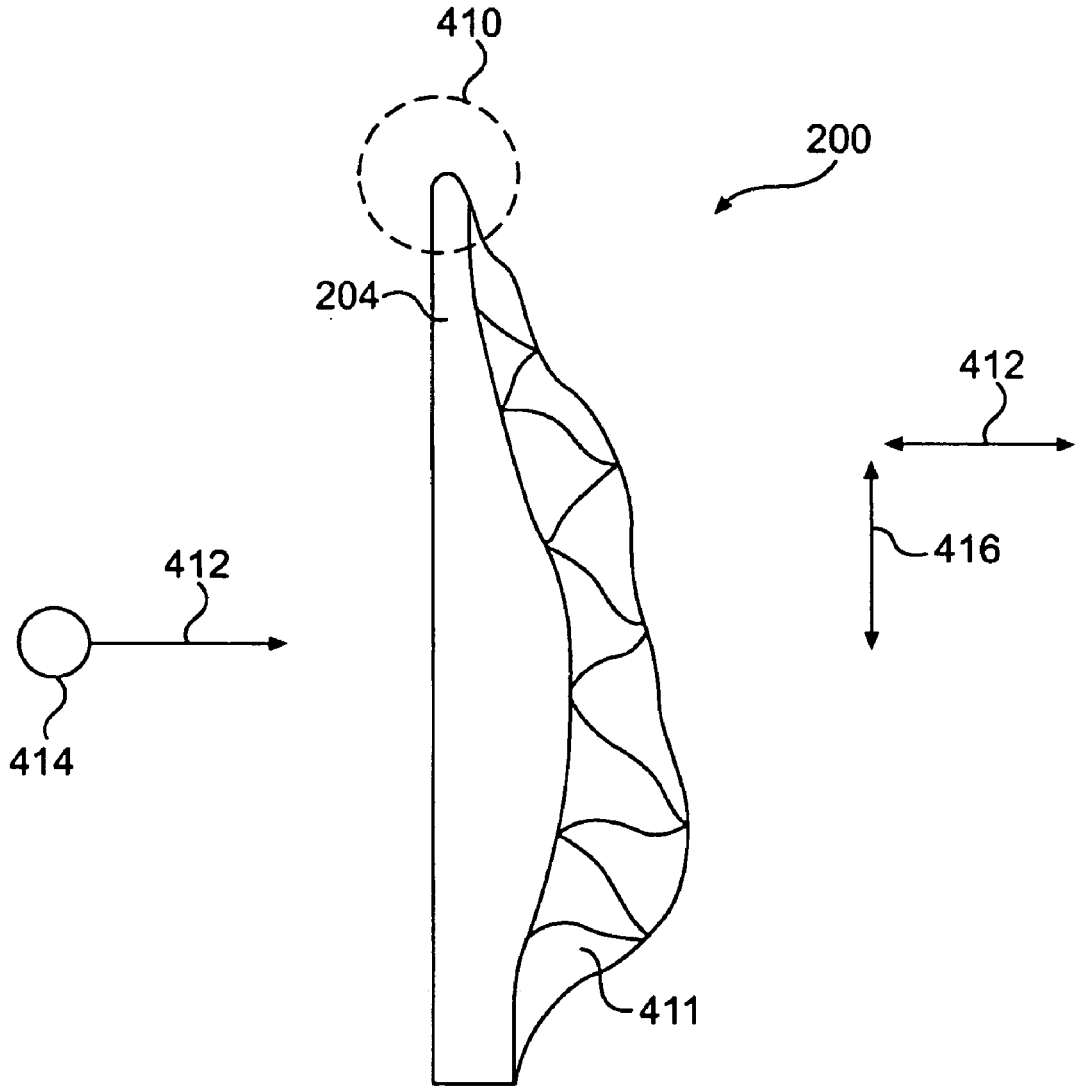
FIG. 4B is a schematic diagram illustrating the movement of the outer skin with respect to thread holes through the scoop of an exemplary lacrosse stick head, according to an embodiment of the present invention.
Figure 4C:
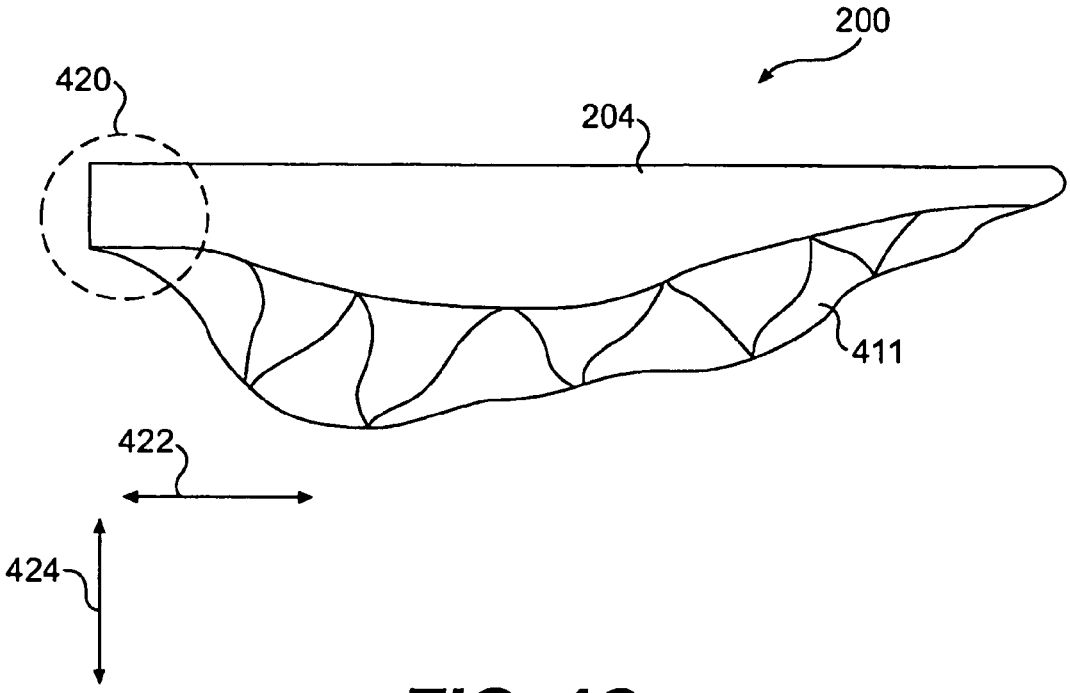
FIG. 4C is a schematic diagram illustrating the movement of the outer skin with respect to thread holes through the ball stop of an exemplary lacrosse stick head, according to an embodiment of the present invention.
Figure 4D:
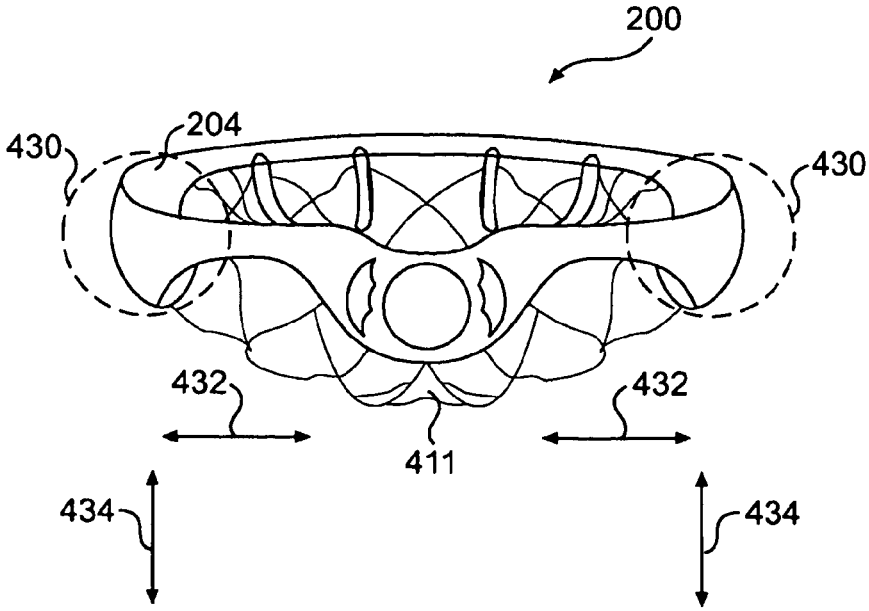
FIG. 4D is a schematic diagram illustrating the movement of the outer skin with respect to thread holes through the sidewalls of an exemplary lacrosse stick head, according to an embodiment of the present invention.

As shown in FIG. 4A, with reference to a particular thread hole 400 through outer skin 204, outer skin 204 can deflect in any direction from substantially parallel 402 to the face of the thread hole 400 to substantially perpendicular 404 to the face of thread hole 400. However, because thread hole 400 can face in different directions relative to the lacrosse head, depending on where it is located in the lacrosse head, the present invention offers different advantages, depending on whether it is applied to the scoop, sidewalls, or ball stop of a lacrosse head. FIGS. 4B, 4C, and 4D illustrate examples of the way in which the present invention can operate in these three different positions.

FIG. 4B demonstrates the movement of outer skin 204 with respect to thread holes through the scoop of a lacrosse head 200, as represented by dotted circle 410. In this scoop location, in a conventionally-strung head, a thong is attached to the thread hole 400 (shown in FIG. 4A) in outer skin 204. Outer skin 204 provides the thong with a dampening flex and recovery in the general direction of arrow 412, after the pocket is impacted by a ball 414 entering the pocket 411 substantially perpendicular to the face of head 200. Specifically, at least a portion of the outer skin 204 surrounding hole 400 (as shown in FIG. 4A) flexes in the general direction of arrow 412 (and direction 404 in FIG. 4A). Thus, the present invention provides "give" in the general direction of arrow 412, thereby deadening the impact of the ball and the rebound of the pocket. This deadening effect enables a player to more easily control the ball, and keep the ball within the lacrosse head pocket.

Outer skin 204 can also provide dampening and recovery characteristics in a direction 416 parallel to the face of head 200, as well as in any component of directions 412 and 416. These directions correspond to situations in which, for example, ball 414 enters pocket 411 in a direction other than perpendicular to the face of head 200, or after the ball is in the pocket and rattles around during cradling.

Thus, when applied to the scoop of a lacrosse head, thread holes through outer skin 204 can dampen the movement of the pocket in any of directions 412, 416, and components thereof. Furthermore, in recovering from flex in any of these directions, outer skin 204 prevents the pocket from acting like a trampoline and ejecting the ball from the pocket prematurely.

In addition to dampening, scoop thread holes through outer skin 204 can provide the pocket with a wider range of motion in any of directions 412, 416, and components thereof. This increased pocket swing enhances ball control during cradling, especially in the general direction of arrow 416.

FIG. 4C illustrates the present invention applied to the ball stop of a lacrosse head 200, as represented by dotted circle 420. In this configuration, in a conventionally-strung head, a thong attaches to thread hole 400 (shown in FIG. 4A). At least a portion of outer skin 204 around thread hole 400 flexes to provide dampening and recovery characteristics in a direction generally parallel to the face of head 200 (as represented by arrow 422), in a direction generally perpendicular to the face of head 200 (as represented by arrow 424), and in any components of the directions 422 and 424.

In the direction of arrow 424, the dampening and gradual recovery characteristics are helpful when receiving a ball that is traveling in a direction perpendicular to the face of head 200. After the ball impacts pocket 411, the pocket pulls against outer skin 204, which then flexes, dampens the movement of the pocket and ball, and then recovers to its original position to keep the pocket and ball from rebounding out of control.

In the direction of arrow 422, the dampening and recovery characteristics are helpful when a ball is moving within pocket 411, such as occurs when cradling or when the lacrosse head is jarred during a defensive check. The present invention therefore dampens the pull of the pocket in the general direction of arrow 422, thereby minimizing the movement of a ball inside the pocket and enabling a player to more easily control the ball, and keep the ball within the lacrosse head pocket.

In directions of components of vectors 422 and 424, outer skin 204 provides dampening and recovery characteristics for situations in which, for example, a ball enters pocket 411 in a direction other than perpendicular to the face of head 200, or after the ball is in the pocket and rattles around in different directions.

In addition to dampening, ball stop thread holes through outer skin 204 can provide the pocket with a wider range of motion in any of directions 422, 424, and components thereof. This increased pocket swing enhances ball control during cradling, especially in the general direction of arrow 422.

FIG. 4D illustrates the present invention applied to one or both of the sidewalls of a lacrosse head 200, as represented by dotted circles 430. In this exemplary configuration, pocket strings (as opposed to thongs) attach to thread hole 400 (shown in FIG. 4A). Outer skin 204 provides a dampening and recovery characteristics in a direction generally parallel to the face of head 200 (as represented by arrow 432), in a direction generally perpendicular to the face of head 200 (as represented by arrow 434), and in any component of directions 432 and 434.

In the direction of arrow 432, the dampening and recovery characteristics are helpful when a ball is moving or swinging within the pocket, such as occurs when cradling or when the lacrosse head is jarred during a defensive check. In this configuration, the present invention therefore dampens the pull of the pocket in the general direction of arrow 432, thereby minimizing the movement of a ball inside the pocket and enabling a player to more easily control the ball, and keep the ball within the lacrosse head pocket. Specifically, when a ball moves within the pocket, causing the suspended pocket to swing, outer skin 204 dampens the movement of the pocket and ball to minimize rattle.

In the direction of arrow 434, the dampening and recovery characteristics are helpful when receiving a ball that is traveling in a direction perpendicular to the face of head 200. After the ball impacts the pocket, the pocket pulls against outer skin 204, which flexes, dampens the movement of the pocket and ball, and then recovers to its original position to keep the pocket and ball from rebounding out of control.

In directions of components of vectors 432 and 434, outer skin 204 provides dampening and recovery characteristics for situations in which, for example, a ball enters the pocket in a direction other than perpendicular to the face of head 200, or after the ball is in the pocket and rattles around in different directions.

In addition to dampening, sidewall thread holes through outer skin 204 can provide the pocket with a wider range of motion in any of directions 432, 434, and components thereof. Compared to a conventional monolithic synthetic lacrosse head, the movement provided by outer skin 204 enables a wider pocket swing. This increased pocket swing enhances ball control during cradling, especially in the general direction of arrow 432. In particular, the increased range of swing allows a ball within pocket 411 to move farther under the sidewalls, to better retain the ball within pocket 411 while cradling.

Figure 5A:
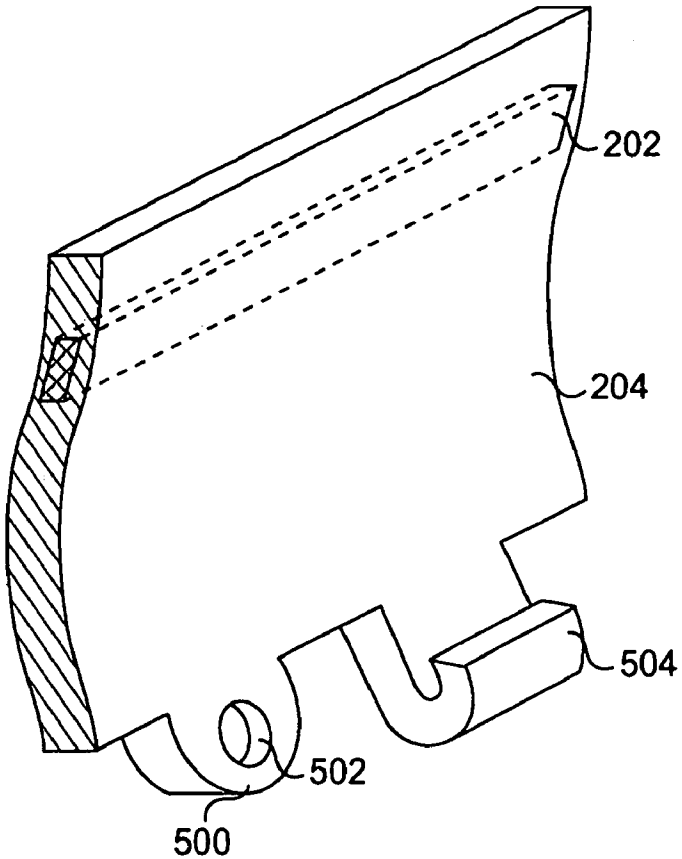
FIG. 5A is a schematic diagram of a section of an exemplary lacrosse stick showing alternative embodiments for provisioning outer skin with means to attach pocket threading, according to embodiments of the present invention.

FIG. 5A illustrates alternative embodiments for provisioning outer skin 204 with means to attach pocket threading. As shown, outer skin 204 could provide a tab 500 having a thread hole 502. As another example, outer skin 204 could provide a hook-shaped tab 504 for retaining pocket threads. In this manner, the material of outer skin 204 from which tabs 502 and 504 are made flexes to provide the pocket with increased range of motion and dampening and recovery characteristics.

In a further embodiment of the present invention, outer skin provides all or a portion of the pocket of a lacrosse head. For example, in addition to forming all or a portion of the sidewalls, the outer skin could extend from the sidewalls to form a pocket as well, e.g., being made of the same material as the sidewalls.

Figure 5B:
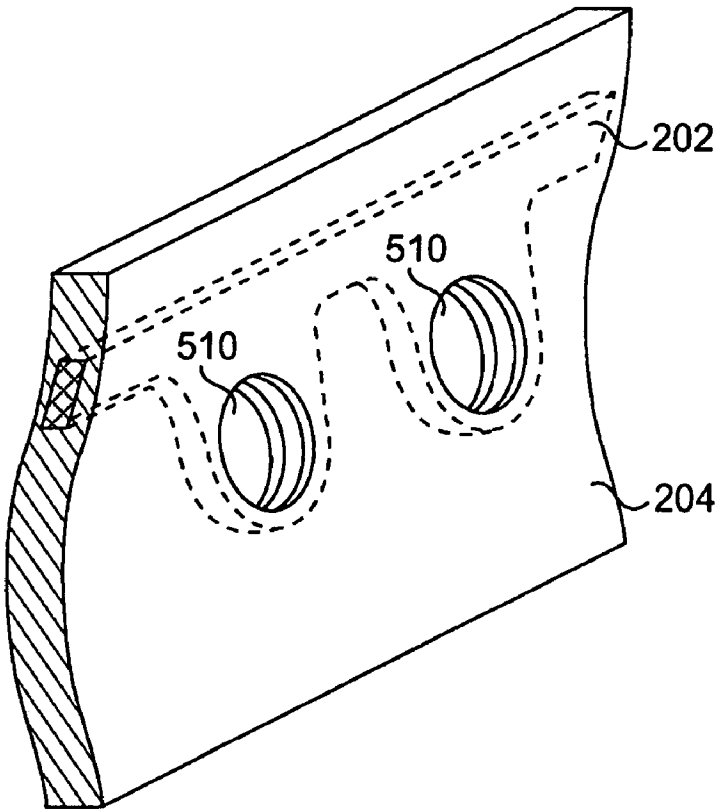
FIG. 5B is a schematic diagram of a section of an exemplary lacrosse stick head showing thread holes disposed through both the outer skin and the skeletal member, according to an embodiment of the present invention.

FIG. 5B illustrates an alternative embodiment of the present invention in which thread holes are disposed through both outer skin 204 and skeletal member 202. This embodiment accommodates a situation in which, for example, more structurally supportive anchor points are needed for pocket threads (e.g., for thongs). For these types of pocket threads, pocket dampening may be less of a concern. Thus, as shown in FIG. 5, holes 510 are disposed through both outer skin 204 and skeletal member 202.

Figure 5C:
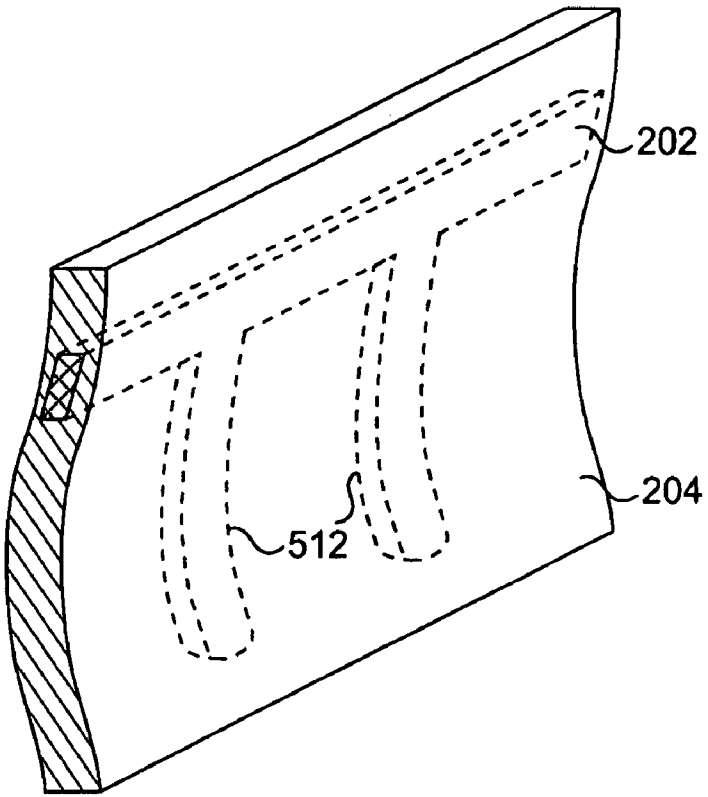
FIG. 5C is a schematic diagram of a section of an exemplary lacrosse stick showing a skeletal member having struts, according to an embodiment of the present invention.

FIG. 5C illustrates another alternative embodiment of the present invention in which skeletal member 202 has one or more struts 512 that provide a desired structural support to outer skin 204. In the particular example of FIG. 5C, struts 512 are narrow members that extend toward the bottom of the sidewall (i.e., the back side of the lacrosse head). Of course, many other numbers and shapes are possible, as necessary to provide the desired structural support to outer skin 204.

In an embodiment of the present invention, a skeletal member is constructed of a durable synthetic material that provides structural support and springiness and serves as a substrate to receive an outer skin. Examples of suitable materials for a skeletal member include nylon, polypropylene (PP), polyethylene (PE), amorphous polar plastics (e.g., polycarbonate (PC)), polymethylmethacrylate (PMMA), polystyrene (PS), high impact polystyrene (HIPS), polyphenylene oxide (PPO), glycol modified polyethylene terphthalate (PETG), acrylonitrile butadiene styrene (ABS), semicrystalline polar plastics (e.g., polyester PET and PBT), polyamide (e.g., Nylon 6 and Nylon 66), urethane, polyketone, polybutylene terephalate, acetals (e.g., Delrin™ by DuPont), acrylic, acrylic-styrene-acrylonitrile (ASA), metallocene ethylene-propylene-diene terpolymer (EPDM) (e.g., Nordel™ by DuPont), and composites.

According to an embodiment of the present invention, the outer skin is applied over the skeletal member by insert molding, reaction injection molding, spray application, rotational molding, dual extrusion, or casting. The outer skin is made of a material that is complementary to the material of a skeletal member, such that the outer skin strongly bonds to the skeletal member, preferably without the use of adhesives or other intermediate bonding layers. Examples of suitable outer skin materials include nylon, urethane (TPU), sanoprene, polycarbonate, alcryln (partially crosslinked halogenated polyolefin alloy), styrene-butadiene-styrene, styrene-ethylene-butylene styrene, thermoplastic olefinic (TPO), thermoplastic vulcanizate (TPV), ethylene-propylene rubber (EPDM), flexible PVC, polyethylene, polypropylene, and ABS. Specifically, for a nylon skeletal member, examples of suitable materials for the outer skin include Santoprene™, styrene-butadiene-styrene, styrene-ethylene-butylene-styrene, and alcryn. For a polycarbonate skeletal member, an example of a suitable material for the outer skin is alcryn (partially crosslinked halogenated polyolefin alloy). Finally, for a polypropylene skeletal member, examples of suitable materials for the outer skin include styrene-ethylene-butylene-styrene and thermoplastic vulcanizate (TPV).

According to one embodiment of the present invention, the outer skin is applied to the skeletal member using multiple material molding or insert molding methods. These methods produce a structure in which the components are strongly bonded such that they move in unison. In multiple material molding, the skeletal member (substrate) is injected first, followed by the outer skin. In insert molding, the skeletal member is pre-formed (e.g., in the case a metal skeletal member) or pre-molded (e.g., in the case of a plastic or composite skeletal member). The skeletal member is then inserted into a cavity. The material of the outer skin (e.g., a melted thermoplastic or thermosetting elastomer) is then injected into the cavity such that it surrounds the skeletal member. After cooling and solidifying, the outer skin is strongly mechanically and/or chemically bonded to the skeletal member.

In addition to injection molding processes, another embodiment of the present invention applies the outer skin to the skeletal member using a reaction injection molding (RIM) method. Reaction injection molding involves the high speed mixing of two or more reactive chemicals as the chemicals are injected into a mold. The mixture flows into the mold at a relatively low temperature, pressure, and viscosity. Curing occurs in the mold at a relatively low temperature and pressure. Reaction injection molding is also referred to as liquid reaction molding or high pressure impingement mixing.

Another embodiment of the present invention applies the outer skin to the skeletal member by spray application. The outer skin can be sprayed on top of the skeletal member. An example of a suitable method for spray application is a polyurea spray elastomer system, such as the GacoFlex RU-92 Polyurea Spray Elastomer System produced by Gaco Western Inc. of Seattle, Wash.

Another embodiment of the present invention applies the outer skin to the skeletal member using a rotational molding method. In a rotational molding process, plastic resin is loaded into a mold, which is then heated and slowly rotated on both its vertical and horizontal axes. As the plastic resin melts under the heat, the rotational movement causes the melting resin to evenly coat every surface of the mold. The mold continues to rotate during the cooling cycle so that the parts retain an even wall thickness. Once the parts cool, they are released from the mold. The rotational speed, heating, and cooling times are all controlled throughout the process.

Another embodiment of the present invention applies the outer skin to the skeletal member using a dual extrusion method. In this method, a first material is fed into an extrusion die along with a second material. Thereafter, the streams merge into one extrusion made of two bonded profiles. The profiles often have different hardnesses, or "dual durometers." A variation of this method is cross-head extrusion, in which introduces a solid material (e.g., metal) into the flow of melted plastic. The solid material becomes part of the extrusion. Cross-head extrusion is typically used when the solid material cannot pass through an extrusion machine's screw and barrel.

Another embodiment of the present invention applies the outer skin to the skeletal member using a low pressure casting method. In this case, the outer skin would be, for example, cast on top of the skeletal member. Of course, the skeletal member could also be cast.

Figure 5D:
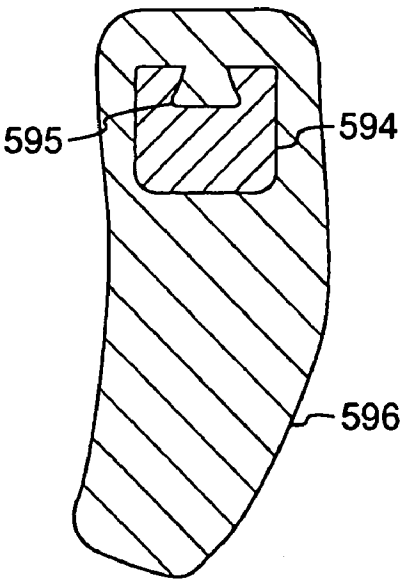
FIG. 5D is a schematic diagram of cross-sectional view of an exemplary interference fit between a skeletal member and an outer skin, according to an embodiment of the present invention.

In addition to the methods described above for applying the outer skin to the skeletal member, a further embodiment of the present invention enhances the bond between the skeletal member and the outer skin using an interference fit or mechanical interlock. For example, a skeletal member can be provisioned with recesses, cavities, depressions, or openings into or through which the outer skin is molded. For example, the skeletal member could have a dovetail slot into which the outer skin is molded. Once hardened, the outer skin would be held in place not only by the bond between the materials of the skeletal member and outer skin, but also by the interference fit of the cooperatively shaped dovetail components of skeletal member and outer skin. As an example, FIG. 5D illustrates a skeletal member 594 having a slot 595 in which the outer skin 596 is disposed and held.

Figure 6:
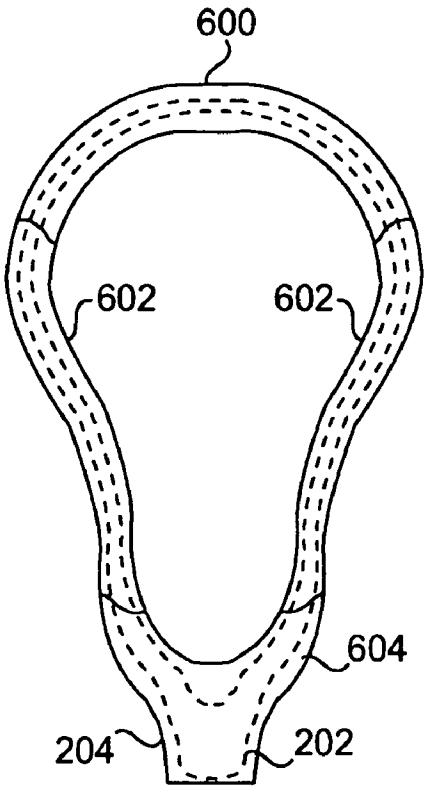
FIG. 6 is a schematic diagram of an exemplary lacrosse stick head having an outer skin composed of multiple materials, according to an embodiment of the present invention.

An alternative embodiment of the present invention accommodates the need for varying performance characteristics (e.g., varying durometer hardnesses) at different locations of a lacrosse head. Accordingly, this embodiment provides an outer skin having regions composed of different materials, for example, including different types of elastomers. The types of materials applied in different areas of the outer skin depend on the performance needs of a particular area. For example, as shown in FIG. 6, one type of elastomer could be used for the portion 600 of outer skin 204 that encapsulates skeletal member 202 in the area of the scoop. A second type of elastomer could be used to encapsulate skeletal member 202 along the sidewalls 602. A third type of elastomer could be used to encapsulate skeletal member 202 in the ball stop area 604. As another option, the same type of elastomer could be used to encapsulate the sidewalls 602 and the ball stop area 604, with a different type of elastomer encapsulating the scoop portion 600. Of course, many more combinations and variations are possible. In addition, although each of the materials of outer skin 204 may offer different performance characteristics, preferably all of the materials share the property of strongly bonding to each other and to the material of skeletal member 202.

Another alternative embodiment of the present invention provides overlays on top of the outer skin. These overlays could be, for example, over molded or insert molded onto the outer skin, and could provide the lacrosse head with further structural features and performance characteristics. For example, these overlays could provide thread openings. Examples of these types of overlays are described in U.S. Pat. No. 6,723,134, which is herein incorporated by reference in its entirety.

A further aspect of the present invention provides a complete lacrosse stick that includes a head having a skeletal member at least a portion of which is encapsulated by an outer skin. As such, this lacrosse stick of the present invention includes a handle and a connector for attaching the head to the handle. The connector can be made of a rigid material, such as nylon, to provide a strong and durable connection between the handle and the skeletal member of the head. The connector can receive and secure the skeletal member on one side and the handle on the other side. Optionally, the connector also receives the outer skin. The connector could also be encapsulated within the outer skin, but does not have to be.

Figure 7:
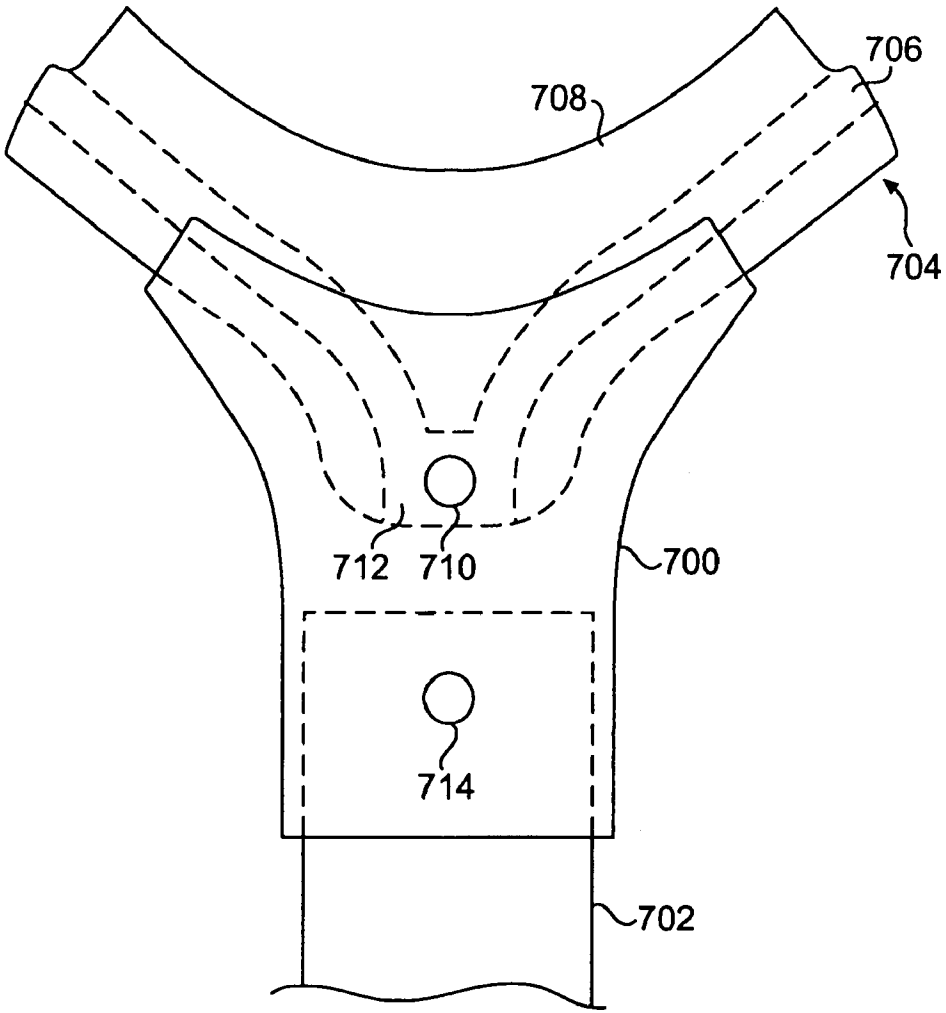
FIG. 7 is a schematic diagram of an exemplary connector that attaches a lacrosse head to a handle, according to an embodiment of the present invention.

In accordance with this embodiment of the present invention, FIG. 7 illustrates an exemplary connector 700 for attaching a handle 702 to a head 704 having a skeletal member 706 at least a portion of which is encapsulated by an outer skin 708. As shown, part of the skeletal member 706 is an extending member 712, which extends from the ball stop portion of skeletal member 706. Extending member 712 provides a rigid structure by which to fasten head 704, and, in this example, includes opening 710 to receive fasteners. Connector 700 can attach to both handle 702 and skeletal member 706 using screws or other fasteners placed through openings 710 and 714. Although the example of FIG. 7 illustrates skeletal member 706 as having an extending member 712 by which to secure head 704, as an alternative embodiment, skeletal member 706 does not have extending member 712, and connector 700 attaches to the ball stop portion of skeletal member 706. In addition, as one of ordinary skill in the art would appreciate, means for attaching these components other than holes and fasteners are possible, such as adhesives or composite layups.

Figure 8:
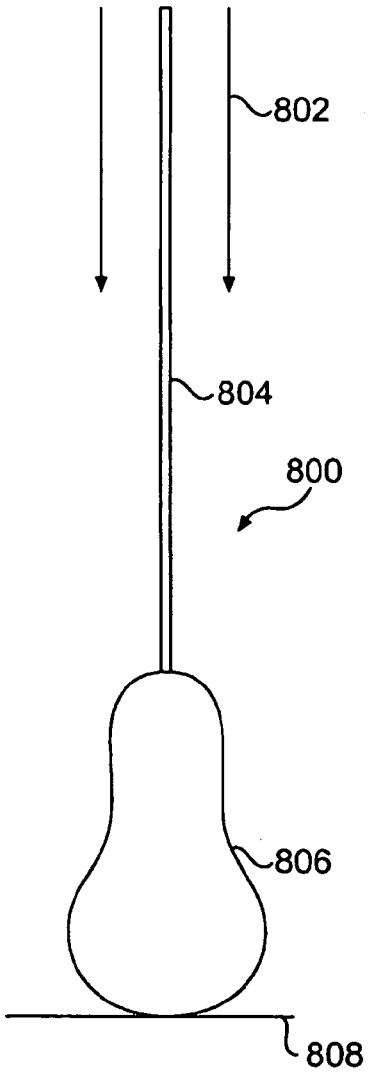
FIGS. 8 and 9 are schematic diagrams of exemplary deflection tests, according to an embodiment of the present invention.
Figure 9:
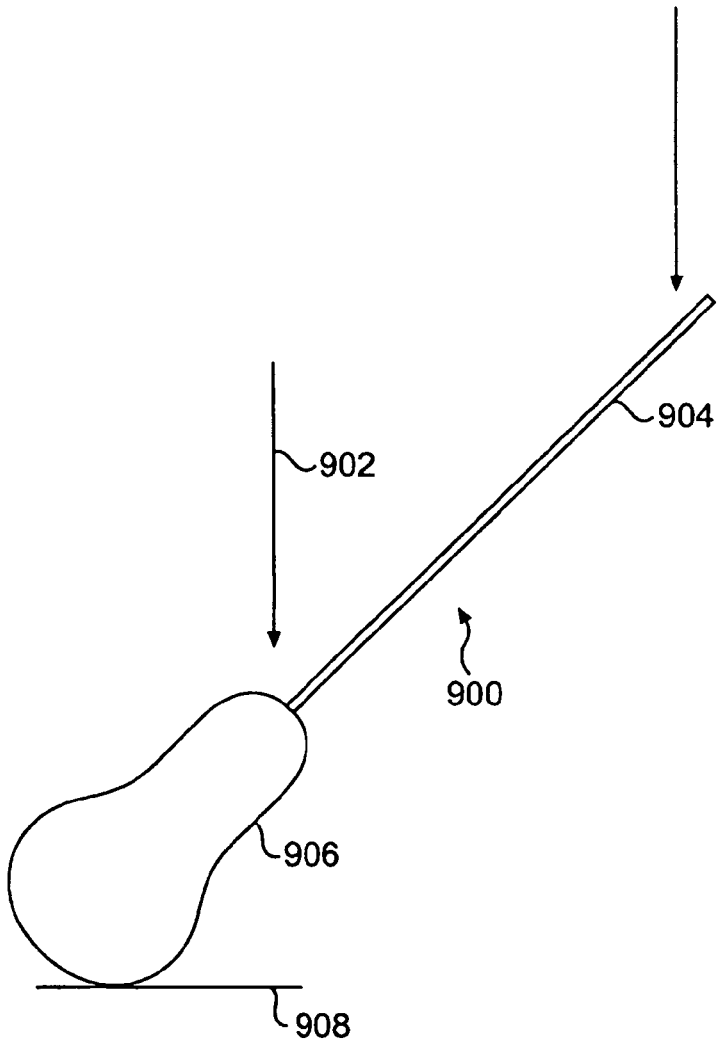

An important aspect of the present invention is the marriage of the skeletal member material with the outer skin material(s). The overall head, once the materials are joined, should meet commonly accepted lacrosse head performance requirements. In other words, the structural design of the skeletal member and the outer skin, in conjunction with the chosen combination of materials, should provide a playable, functioning lacrosse stick head. For example, as one possible test of playability, a lacrosse head according to the present invention could satisfy finite element analysis and deflection tests that require a maximum of about a 0.5-1.2 inch deflection (e.g., setting a maximum of 0.8 inches) in response to an approximately 60-pound force applied to the scoop in a direction substantially parallel to the axis of a shaft attached to the head. FIG. 8 shows this exemplary deflection test on a lacrosse stick 800, with a vertical force 802 applied to the stick 800 in a direction parallel to the axis of shaft 804, and with the head 806 in contact with the ground 808. FIG. 9 illustrates an alternative deflection test on a lacrosse stick 900, with an approximately 30-pound vertical force 902 applied to the shaft 904 with the shaft 904 positioned at about a 45 degree angle to the ground 906, and with the head 908 of the stick 900 in contact with the ground 908. In this alternative test, the lacrosse head should not deflect greater than about 1.5-3.0 inches (e.g., setting a maximum of 2.33 inches).

Figure 10A:
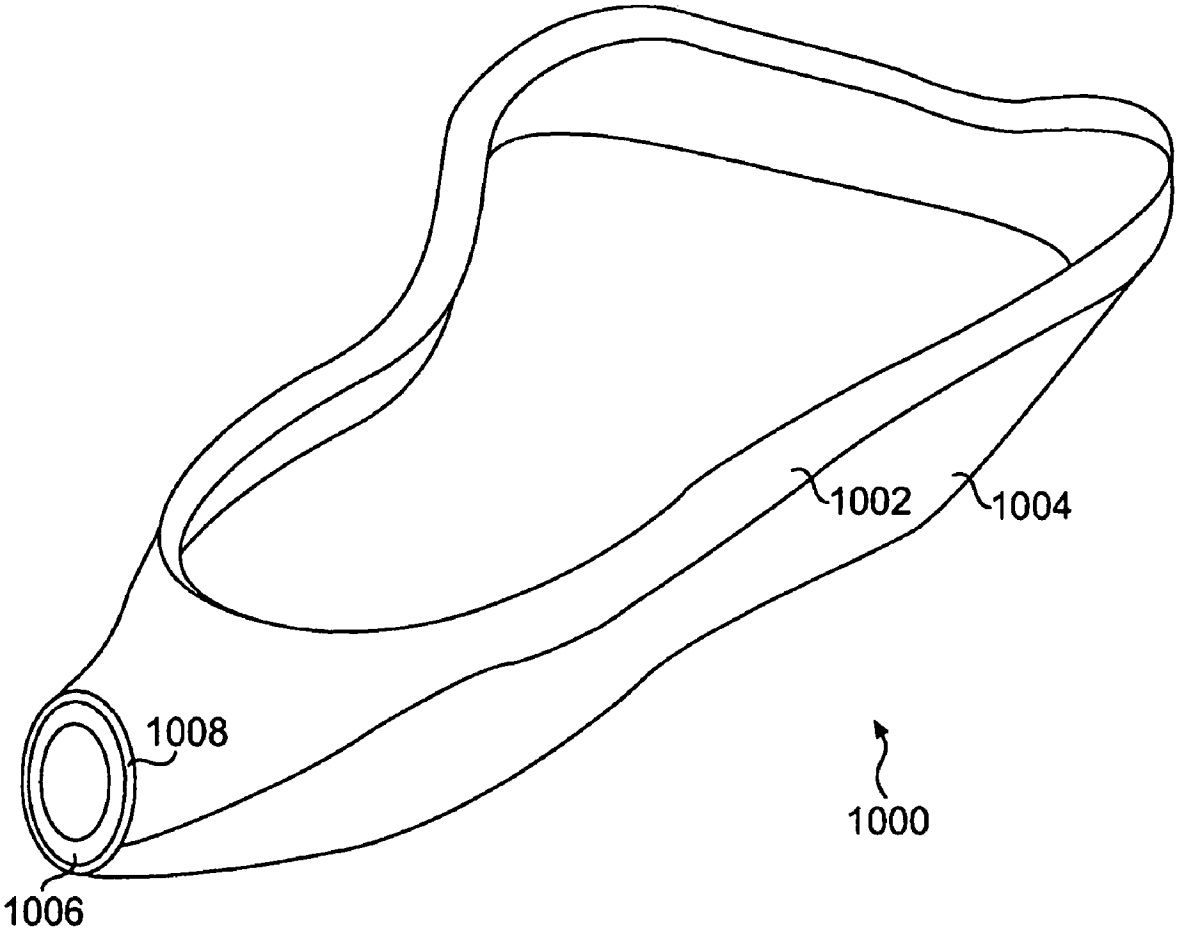
FIGS. 10A and 10B are schematic diagrams of another exemplary lacrosse stick head, according to an embodiment of the present invention.
Figure 10B:
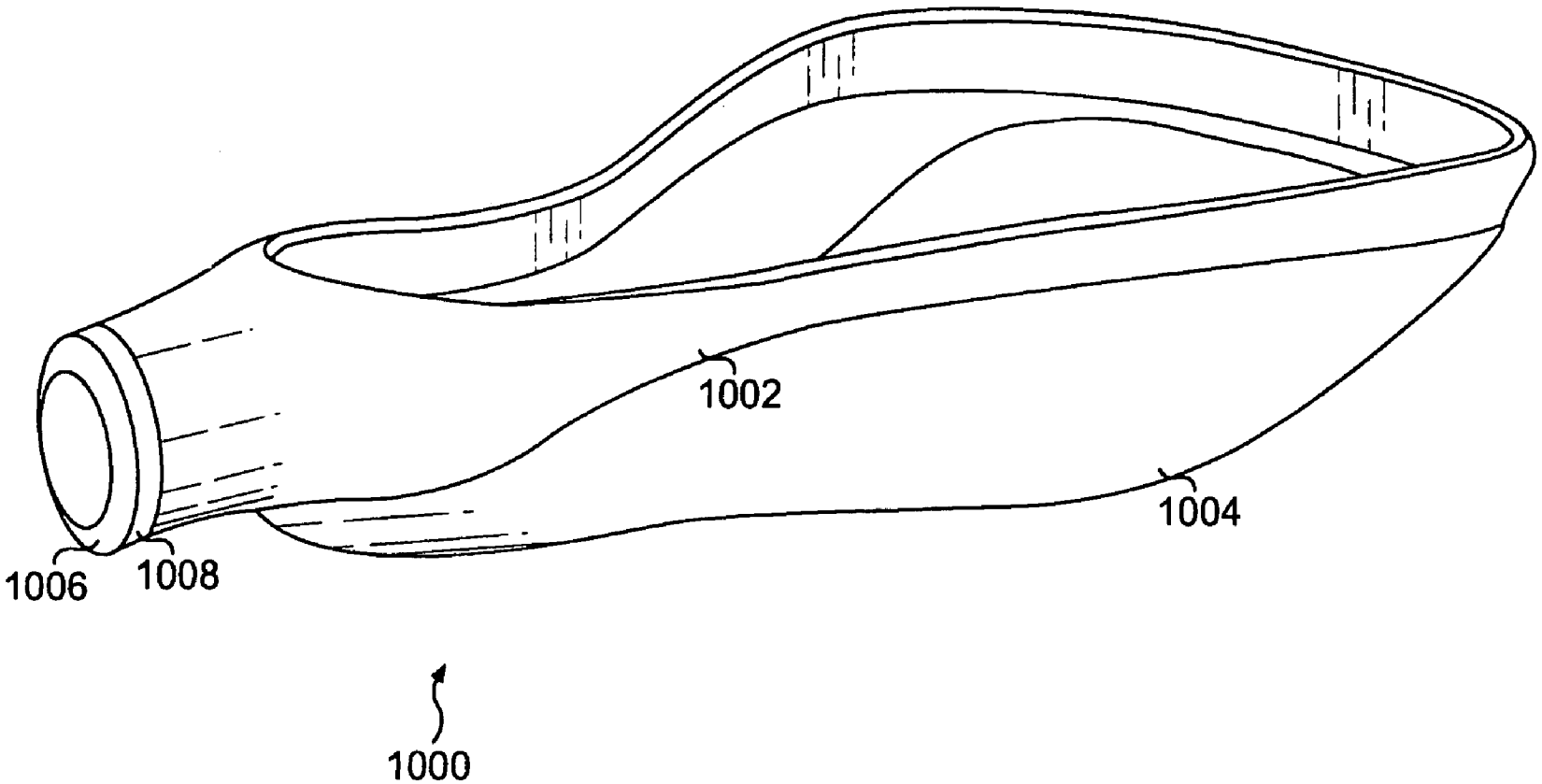

FIGS. 10A and 10B illustrate another exemplary lacrosse stick head 1000, according to an embodiment of the present invention. As shown, head 1000 includes a skeletal member 1002 formed in a closed loop, with an outer skin 1004 encapsulating the skeletal member 1002. Skeletal member 1002 defines a socket 1006 in the juncture of head 1000, which provides the internal structural support and rigidity needed to secure head 1000 to a handle (not shown) inserted into socket 1006. The end 1008 of outer skin 1006 can encapsulate skeletal member 1002 in the area of socket 1006 as shown.

The foregoing disclosure of the embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A lacrosse head comprising:

a skeletal member formed in a closed loop, the skeletal member comprising a first sidewall portion, a second sidewall portion, a juncture portion joining the first and second sidewall portions, and a scoop portion joining the first and second sidewall portions opposite the juncture portion, the skeletal member being continuous from the juncture portion, through the first sidewall portion, through the scoop portion, through the second sidewall portion, and back to the juncture portion, the junction portion forming a juncture of the head adapted to receive a shaft; and an outer skin applied over the skeletal member, the skeletal member and the outer skin together forming a stop member adjacent to the juncture, two sidewalls, and a scoop connected to the two sidewalls opposite the stop member, the outer skin encapsulating at least a portion of the skeletal member along the two sidewalls, the skeletal member having a cross-sectional area less than approximately half of a cross-sectional area of the outer skin at a cross-section taken along a sidewall of the lacrosse head, the outer skin made of a first material and the skeletal member made of a second material, the first material having a durometer hardness lower than that of the second material, the juncture portion defining an opening in which to receive a shaft, the juncture portion being comprising a continuous ring around the opening such that the juncture portion encloses a shaft placed in the opening, and the juncture portion of the skeletal member providing the lacrosse head with structural support necessary to connect the lacrosse head to the shaft.

2. The lacrosse head of claim 1, the second material being more compressible and elastic than the first material.

3. The lacrosse head of claim 1, the skeletal member being solid.

4. The lacrosse head of claim 1, the head deflecting a maximum of about 0.5-1.2 inches in response to an approximately 60-pound force applied to the head in a direction parallel to a longitudinal axis of a shaft connected to the head.

5. The lacrosse head of claim 1, the outer skin applied to the skeletal member by one of insert molding, reaction injection molding, spray application, rotational molding, dual extrusion, and casting.

6. The lacrosse head of claim 5, the outer skin further joined to the skeletal member by an interference fit.

7. The lacrosse head of claim 6, the interference fit comprising cooperatively shaped dovetail components in the skeletal member and the outer skin.

8. The lacrosse head of claim 1, the outer skin defining an opening adapted to receive pocket threading.

9. The lacrosse head of claim 1, the outer skin defining a tab adapted to receive pocket threading.

10. The lacrosse head of claim 9, the tab being hook-shaped.

11. The lacrosse head of claim 1, the skeletal member and the outer skin defining an opening adapted to receive pocket threading.

12. The lacrosse head of claim 1, the outer skin defining openings adapted to receive pocket threading, and the outer skin being at least one of elastic, resilient, and shock absorbing.

13. The lacrosse head of claim 1, the lacrosse head having a back side adapted to receive a pocket and a front side opposite the back side, and the skeletal member being disposed in the two sidewalls within the outer skin nearer the front side than the back side.

14. The lacrosse head of claim 13, the skeletal member having a strut that extends toward the back side.

15. The lacrosse head of claim 1, the lacrosse head having a back side adapted to receive a pocket and a front side opposite the back side, and the skeletal member being disposed in the two sidewalls within the outer skin nearer the back side than the front side.

16. The lacrosse head of claim 1, the first material of the outer skin divided into separate portions, each of the separate portions comprising a different material, each of the different materials having a durometer hardness lower than that of the second material.

17. The lacrosse head of claim 16, a first portion of the outer skin encapsulating the skeletal member at the stop member, a second portion of the outer skin encapsulating the skeletal member at the two sidewalls, and a third portion of the outer skin encapsulating the skeletal member at the scoop, and the first portion, the second portion, and the third portion each made of a material having a durometer hardness different from the materials of the other two portions.

18. The lacrosse head of claim 16, a first portion of the outer skin comprising the stop member and the two sidewalls, and a second portion of the outer skin comprising the scoop.

19. The lacrosse head of claim 1, the skeletal member comprising one of nylon, polypropylene, polyethylene, amorphous polar plastics, polymethylmethacrylate, polystyrene, high impact polystyrene, polyphenylene oxide, glycol modified polyethylene terphthalate, acrylonitrile butadiene styrene, semicrystalline polar plastics, polyamide, urethane, polyketone, polybutylene terephalate, acetals, acrylic, acrylic-styrene-acrylonitrile, metallocene ethylene-propylene-diene terpolymer, spring steel, and fiber reinforced composites.

20. The lacrosse head of claim 1, the outer skin comprising one of nylon, urethane, sanoprene, polycarbonate, partially crosslinked halogenated polyolefin alloy, styrene-butadiene-styrene, styrene-ethylene-butylene styrene, thermoplastic olefinic, thermoplastic vulcanizate, ethylene-propylene rubber, polyvinyl chloride, polyethylene, polypropylene, and acrylonitrile butadiene styrene.

21. The lacrosse head of claim 1, the outer skin encapsulating the skeletal member along the scoop.

22. The lacrosse head of claim 1, further comprising a shaft disposed in the juncture, the juncture portion of the skeletal member being directly connected to the shaft.

23. The lacrosse head of claim 1, the juncture portion comprising a socket that fully encloses an end portion of the shaft, the juncture portion being disposed radially between the outer skin and the shaft thereby separating the outer skin from the shaft.

24. The lacrosse head of claim 23, the opening comprising a cylindrical opening.

* * * * *